US005580322A

United States Patent [19]

Bouquet

[11] Patent Number: 5,580,322

[45] Date of Patent: Dec. 3, 1996

[54] WOOD GOLF CLUBHEAD ASSEMBLY WITH PERIPHERAL WEIGHT ON CLUBFACE

[76] Inventor: Harry Bouquet, 13582 Mindora Ave., Sylmar, Calif. 91342

[21] Appl. No.: 490,777

[22] Filed: Jun. 15, 1995

[51] Int. Cl.[6] ..... A63B 53/04

[52] U.S. Cl. ..... 473/342; 473/343

[58] Field of Search ..... 273/167 R, 169, 273/167 F, 167 H, 167 J, 167 K, 170, 171, 172, 173, 175, 167 D, 77 R, 193 R, 194 R, 194 B; 473/342, 343

[56] References Cited

U.S. PATENT DOCUMENTS

| | | | |
|---|---|---|---|
| 1,423,341 | 7/1922 | Lippincott | 273/173 |
| 3,084,940 | 4/1963 | Cissel | 273/173 |
| 3,695,618 | 10/1972 | Woolley | 273/173 |
| 3,863,932 | 2/1975 | Lezatte | 273/173 |
| 4,023,802 | 5/1977 | Jepson | 273/173 |
| 4,618,149 | 10/1986 | Maxel | 273/171 |
| 4,804,188 | 2/1989 | McKee | 273/173 |
| 5,044,637 | 9/1991 | Wilson | 273/169 |
| 5,076,585 | 12/1991 | Bouquet | 273/167 F |
| 5,172,913 | 12/1992 | Bouquet | 273/167 F |

FOREIGN PATENT DOCUMENTS

| | | | |
|---|---|---|---|
| 2251556 | 7/1992 | United Kingdom | 273/167 R |

*Primary Examiner*—Sebastiano Passaniti
*Attorney, Agent, or Firm*—Bruce H. Johnsonbaugh

[57] ABSTRACT

A wooden golf clubhead assembly is provided having an obround swingweight carried in the clubface. The club assembly has a relatively narrow width relative to the length of the clubface. The clubface is flat and the overall assembly has a center of gravity relatively close to the clubface resulting in greater accuracy for off-center hits.

4 Claims, 1 Drawing Sheet

WOOD GOLF CLUBHEAD ASSEMBLY WITH PERIPHERAL WEIGHT ON CLUBFACE

BACKGROUND OF THE INVENTION

The present invention relates in general to a wood golf clubhead design. In particular, the present invention relates to an improvement over the design shown in my U.S. Pat. No. 5,076,585 dated Dec. 31, 1991.

SUMMARY OF THE INVENTION

The present invention relates to a wood golf club assembly designed to obtain optimum distance and accuracy for center and off-center hits on the clubface.

The new clubhead assembly includes a peripheral weight carried on the clubface and wherein the width of the clubhead is narrow. This combination provides a center of gravity relatively close to the clubface. By locating the center of gravity close to the clubface, I have been able to achieve a reduction in gear effect. The new design offers relatively high accuracy for off-center hits.

A primary object of the invention is to provide a new wood golf clubhead assembly which incorporates a flat clubface design and reduced gear effect.

Another object of the invention is to provide a wood golf clubhead assembly wherein a swingweight is mounted directly onto the clubface and wherein the length to width ratio of the clubhead design, combined with the swingweight on the clubface, provides reduced gear effect and increased accuracy for off-center hits.

DETAILED DESCRIPTION OF THE DRAWINGS

Figure 1:
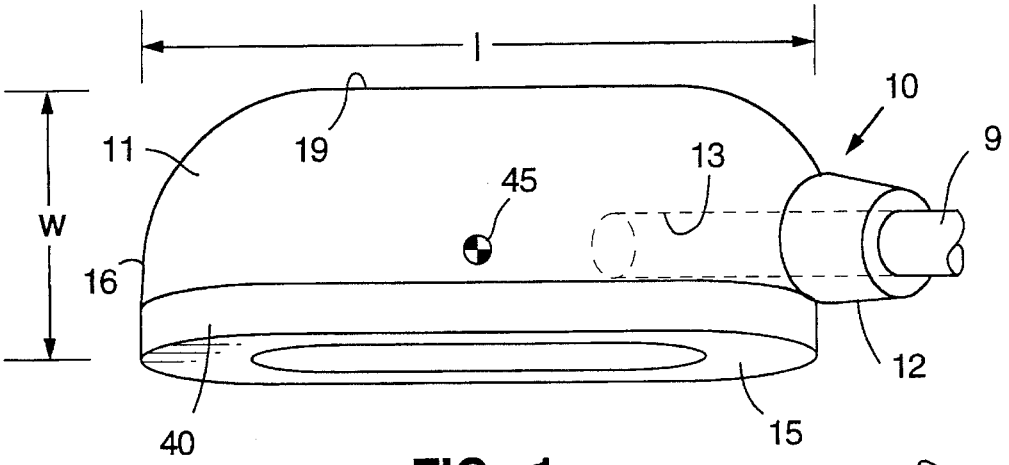
FIG. 1 is a top view of the clubhead assembly according to the present invention.
Figure 2:
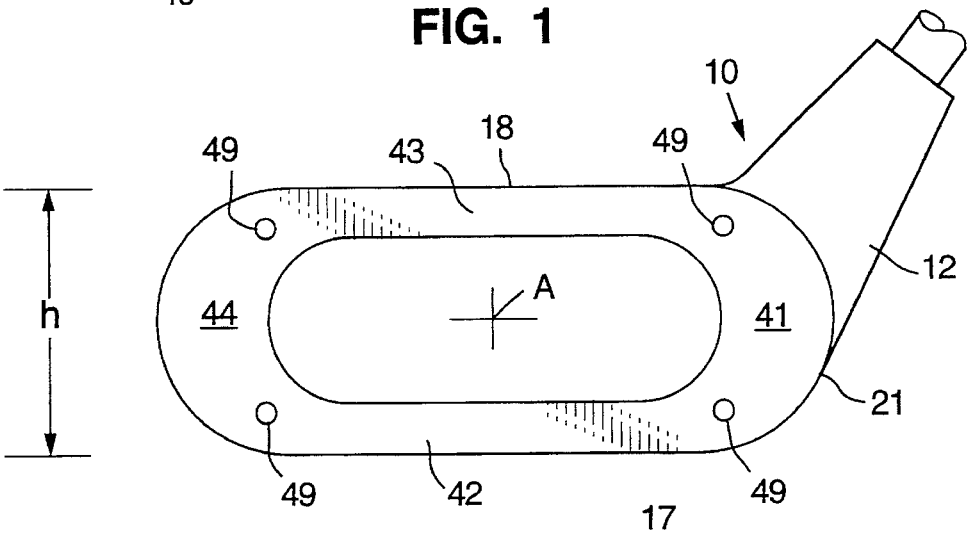
FIG. 2 is a front elevational view showing the clubface and a portion of the shaft.
Figure 3:
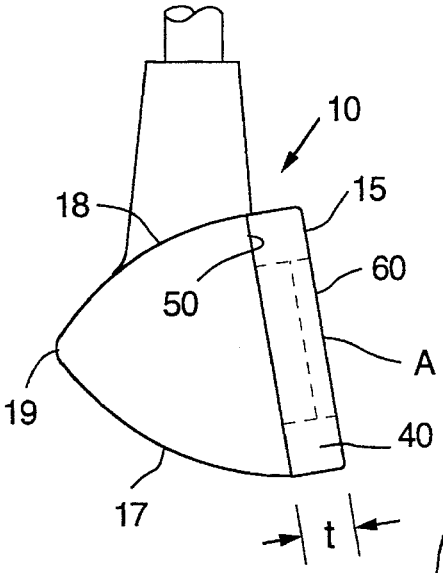
FIG. 3 is a side elevational view looking at the toe of the golf clubhead assembly of the present invention.

FIGS. 1–3 show a golf club assembly generally as 10. The assembly 10 includes a wooden blank 11 and a metallic swingweight 40. A heel portion 12 of the clubhead is adapted to receive a club shaft 9 through cylindrical bore 13. A generally flat clubface 15 extends from the heel 12 to the toe portion 16 of wooden blank 11. A convex sole portion 17 forms the bottom of the clubhead assembly 10. The top 18 of the clubhead is a smooth convex surface. The back 19 of the clubhead comprises a rounded corner formed by the conjuncture of the convex top 18 and the convex sole 17.

As shown in FIG. 1, the overall length 1 of the clubface extends from the toe portion 16 to the base 21 of the heel portion 12. The overall width of the clubhead assembly extends from the clubface 15 to the back 19 of assembly 10. In the preferred embodiment of the invention, the overall length l is 3.8 inches and the overall width w is 1.5 inches. I have found that using a length to width ratio of greater than 2.5, there is improved accuracy for off-center hits. The overall height of the clubhead as shown in FIG. 2 extends from the sole 17 to the top 18. In the preferred embodiment, the overall height h is 1.5 inches, the same dimension as the overall width w.

Figure 4:
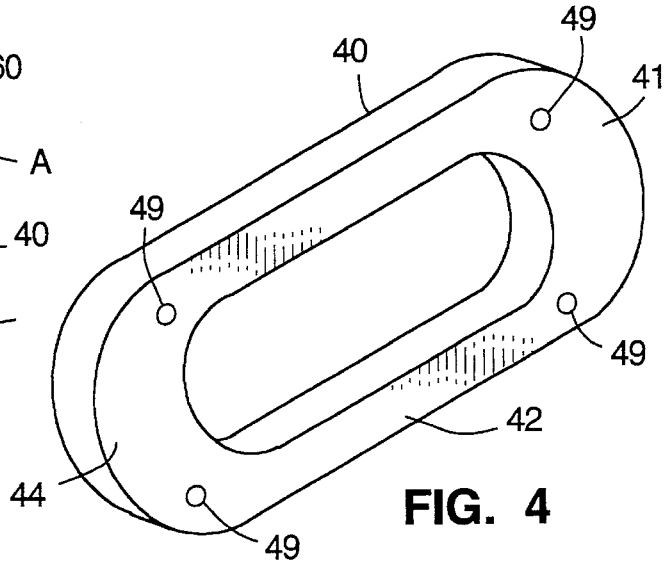
FIG. 4 is a perspective view of the swingweight utilized in the present invention.

The swingweight 40 is of obround design as shown in FIG. 4 which extends around the periphery of clubface 15 of the overall clubhead assembly as shown best in FIG. 1. The portions of swingweight 40 that extend around the heel and toe of the clubface are substantially wider than the portions which extend along the sole 17. As shown best in FIG. 2, the portion 41 of swingweight 40, which covers the heel portion 12 of the clubface, is wider than the portion 42 which runs along the sole 17 of the clubhead and portion 43 which runs across the top of the clubhead 18. Portion 44 covers the toe of the clubface and is of the same width as the portion 41 which covers the heel portion of the clubface. In the preferred embodiment, the width of portions 41 and 44 is approximately twice the width of the portions 42 and 43. I have found that by increasing the weighting at the heel and toe portions of the clubface, increased accuracy can be obtained for off-center hits.

Swingweight 40 in the preferred embodiment has an overall thickness t of 5/16ths inch. A recess 50 is formed in the wooden blank 11 to accept the swingweight 40. Recess 50 has a depth of 3/16ths inch. After the swingweight has been mounted on the clubface as shown in FIG. 3, epoxy 60 is used to fill the central portion of the clubface and to protect the central portion of the clubface. The depth of the epoxy filler is approximately 1/8th inch. Swingweight 40 has four mounting holes 49 through which screws (not shown) are driven to secure the swingweight 40 to the wooden blank 11. Epoxy cement is also used in conjunction with four mounting screws to attach the swingweight 40.

The center of the clubface is shown as A and is represented in FIG. 3 by an imaginary dot. The distance from the center of the clubface A to the rear of the clubhead assembly 19 forms the dimension w representing the overall width of the clubhead assembly. The center of gravity 45 shown in FIG. 1 is located rearwardly from the center of the clubface A, a distance of 0.40 inches in the preferred embodiment.

The preferred embodiment described above has been tested at Golf Laboratories using their "Iron Byron" golf driving machine with improved results including reduced gear effect and increased accuracy for off-center hits compared with the design shown in my U.S. Pat. No. 5,076,585.

As shown in the drawings, a flat clubface is usable in the present invention, whereas most drivers of the prior art require a bulge and roll radius. The flat clubface of the present invention is made possible by the use of the peripheral weight mounted on the clubface together with a rather narrow width club to move the center of gravity 45 close to the clubface 15. The use of the flat clubface maximizes accuracy for hits occurring at the center of the clubface. The overall design according to the present invention affords increased accuracy for balls hit off-center as well.

The material used in the swingweight 40 is preferably brass but other materials may be utilized. The sole portion 42 of swingweight 40 may be thicker than portion 43 to add sole weight. Also, either the heel portion 41 or toe portion 44 may be enlarged to satisfy particular users.

Summarized below in Table I are the dimensions and center of gravity locations for eight clubs built according to the present invention:

TABLE I

| DATA FOR SET OF EIGHT GOLF CLUBS OF OPTIMUM WEIGHT DISTRIBUTION | | | | | |
|---|---|---|---|---|---|
| CLUB NO. | HEAD WT. OZ. | LOFT ANGLE DEG. | LIE ANGLE DEG. | CLUB HD. C.G. IN. | CLUB LENGTH IN. |
| 1 | 7.02 | 10 | 54 | 0.40 | 43 |
| 1A | 7.10 | 12 | 54 | " | 43 |
| 2 | 7.23 | 14 | 54 | " | 42.5 |
| 3 | 7.44 | 18 | 54 | " | 42 |
| 4 | 7.66 | 22 | 55 | " | 41 |
| 5 | 7.87 | 26 | 55 | " | 41.5 |
| 6 | 8.08 | 30 | 56 | " | 40.5 |
| 7 | 8.29 | 35 | 56 | " | 40 |

What is claimed is:

1. In a golf clubhead assembly wherein a wooden clubhead has a heel portion adapted to receive a tubular club shaft, a generally flat clubface having no bulge or roll radius extending from said heel portion to a toe portion, a sole forming a bottom of said clubhead, and a smooth, convex surface forming a top of said clubhead, the improvement comprising:

an obround recess formed in said flat clubface, extending around the periphery of said flat clubface;

an obround swingweight inserted within and carried by said recess in said clubface, said swingweight extending around the periphery of said clubface, and wherein said swingweight is made of dense metal and comprises 40% to 60% of the total weight of said clubhead assembly;

means for holding said swingweight in said recess wherein the length of said clubface is more than 2.5 times the width of said clubhead assembly, and wherein said clubhead assembly has smooth and convex top and sole surfaces.

2. The apparatus of claim 1 wherein the width of said clubhead assembly is 1.5 inches and the length of said clubface is 3.8 inches, and said swingweight is thick enough that the center of gravity of said clubhead assembly is 0.40 inches from a plane containing said clubface.

3. The apparatus of claim 1 wherein said clubhead assembly has a center of gravity no more than 0.40 inches from a plane containing said clubface.

4. The apparatus of claim 1 wherein said obround swingweight is wider at the heel and toe portions than at the top and bottom portions of said clubface.

* * * * *

UNITED STATES PATENT AND TRADEMARK OFFICE

CERTIFICATE OF CORRECTION

PATENT NO. : 5,580,322

DATED : December 3, 1996

INVENTOR(S) : Harry Bouquet

It is certified that error appears in the above-indentified patent and that said Letters Patent is hereby corrected as shown below:

In Table 1, shown at column 3, lines 1-15, the "Club Length In." for "Club Nos. 4 and 5" is shown as:

| Club No. | Club Length In. |
|---|---|
| 4 | 41 |
| 5 | 41.5 |

and should be

| Club No. | Club Length In. |
|---|---|
| 4 | 41.5 |
| 5 | 41 |

Signed and Sealed this

Eighteenth Day of February, 1997

*Attest:*

*Attesting Officer*

Bruce Lehman

BRUCE LEHMAN

*Commissioner of Patents and Trademarks*